United States Patent [19]

Askinasi

[11] Patent Number: 4,569,142

[45] Date of Patent: Feb. 11, 1986

[54] ATHLETIC SHOE SOLE

[76] Inventor: Joseph K. Askinasi, 133 E. 58th St., New York, N.Y. 10022

[21] Appl. No.: 571,419

[22] Filed: Jan. 17, 1984

[51] Int. Cl.[4] ..... A43B 5/00; A43B 13/04; A43B 13/26

[52] U.S. Cl. ..... 36/134; 36/32 R; 36/59 C; D2/320

[58] Field of Search ..... 36/32 R, 59 R, 59 C, 36/134, 25 R; D2/320

[56] References Cited

U.S. PATENT DOCUMENTS

| | | | |
|---|---|---|---|
| D. 210,714 | 4/1968 | Pradet | D2/320 |
| 299,691 | 6/1884 | Smith . | |
| 2,930,149 | 3/1960 | Hack et al. | 36/28 |
| 2,981,011 | 4/1961 | Lombardo | 36/59 |
| 3,006,085 | 10/1961 | Bingham, Jr. | 36/59 C |
| 3,354,561 | 11/1967 | Cameron | 36/134 |
| 3,507,059 | 4/1970 | Vietas | 36/59 C |
| 3,619,916 | 3/1970 | Neri | 36/59 R |
| 4,184,272 | 1/1980 | Riggs | 36/128 |
| 4,187,623 | 2/1980 | Dassler | 36/32 R |
| 4,212,120 | 7/1980 | Bowerman et al. | 36/129 |
| 4,241,524 | 12/1980 | Sink | 36/59 C |
| 4,372,058 | 2/1983 | Stubblefield | 36/32 R |
| 4,378,643 | 4/1983 | Johnson | 36/129 |

FOREIGN PATENT DOCUMENTS

| | | | |
|---|---|---|---|
| 510884 | 3/1955 | Canada | 36/59 C |
| 249549 | 9/1966 | Fed. Rep. of Germany | 36/59 C |

*Primary Examiner*—Henry S. Jaudon
*Assistant Examiner*—Steven N. Meyers
*Attorney, Agent, or Firm*—Beveridge, DeGrandi & Weilacher

[57] ABSTRACT

An athletic shoe outsole minimizes the likelihood of injury to a wearer's foot from injuries attending fixation by providing a flexible sole extending the length of the wearer's foot with cleats on the sole over about the forward one-third thereof and transverse ribs on the sole over about the rear two-thirds thereof such that the forward one-third provides the wearer with omnidirectional traction and the rear two-thirds provide the wearer with only longitudinal traction.

7 Claims, 5 Drawing Figures

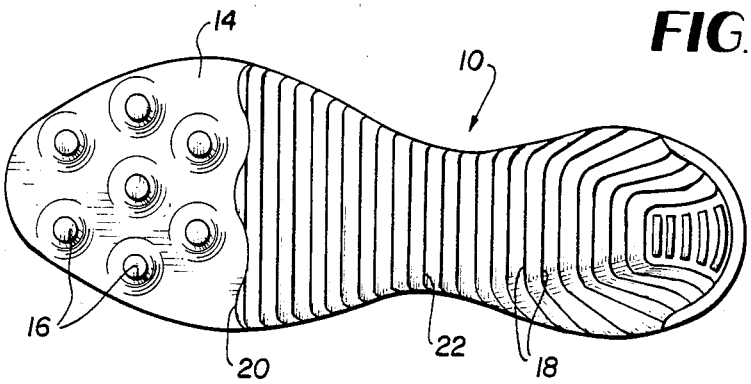
FIG. 2
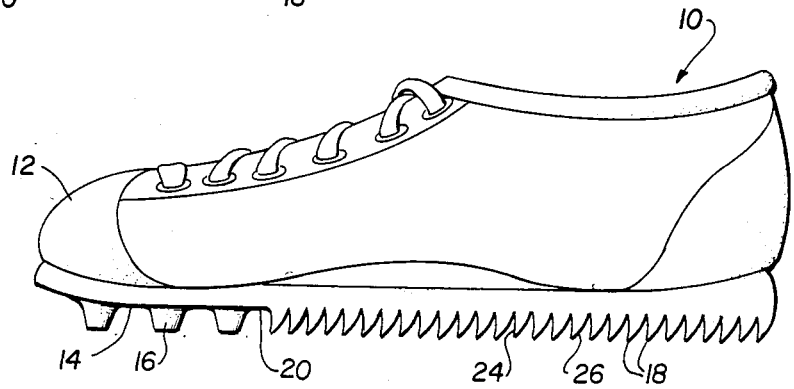
FIG. 1
FIG. 3
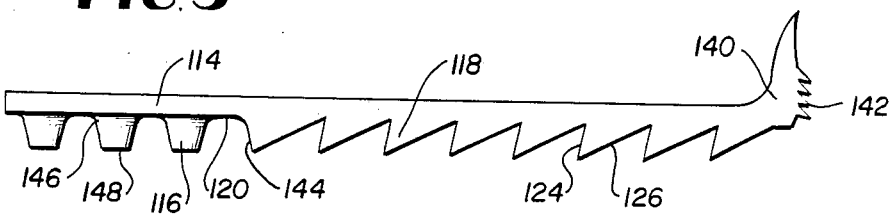
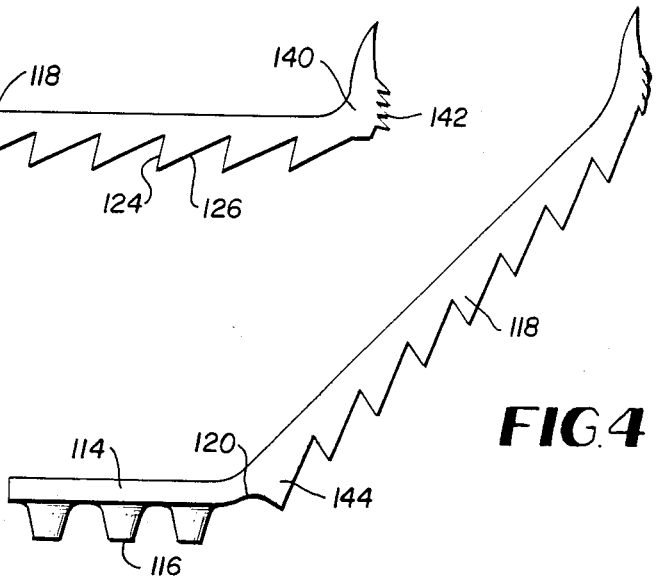
FIG. 4
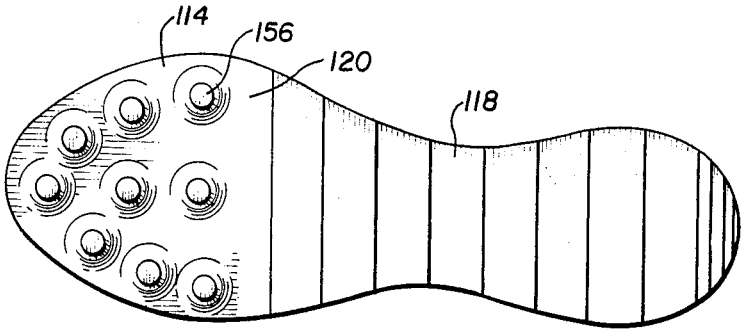
FIG. 5

ATHLETIC SHOE SOLE

BACKGROUND OF THE INVENTION

The present invention relates to athletic shoes and more particularly to a sole therefor having an outsole tread arrangement to reduce the likelihood of injuries attending fixation.

Typically, athletic shoes for sports such as football or soccer have means on the lower parts of the soles for increasing the traction that the wearer has with the ground. Usually the traction imparting elements are cleats, in the form of studs which protrude downwardly from the sole so that when a wearer puts his weight on the shoe on the ground, the cleats penetrate the surface of the ground. Slippage of the shoe with respect to the ground is thereby minimized.

However, in practice it has been found that there are occasions when slippage of the shoe is desirable. These arise most often in the case of contact sports such as football or soccer in which players collide with one another with regularity. In certain collisions a force is imparted to the lower part of the body and acts to exert a sideways motion on the foot, but given the fixation of the shoe by the cleats, motion of the shoes does not take place. Instead, the force of the collision causes injury to the player, including such injuries as torn ligaments, cartilage or the like. Injuries resulting from this problem are termed fixation injuries.

Several attempts have been made to design athletic shoes to avoid fixation injuries, with limited success. U.S. Pat. No. 3,354,561 to Cameron discloses an athletic shoe sole having a rotatable plate attached to the front portion of the sole with a plurality of cleats affixed to the plate. The heel consists of two arcuate ribs which are provided with beveled ends. The Cameron device has several drawbacks. First, the rotatable plate may rotate at undesired times, leading to loss of control when running and perhaps other injury. In addition, the Cameron sole requires the assembly of numerous parts, increasing production costs.

U.S. Pat. No. 3,619,916 to Neri also discloses an athletic shoe which is intended to avoid fixation injuries. In the Neri patent an athletic shoe is provided with toe and heel cleats and a safety traction block having a plurality of integral, spaced, parallel, laterally extending, saw-tooth-like, ground engaging ribs between the toe and heel cleats.

SUMMARY OF THE INVENTION

Applicant has devised an improved athletic shoe with an outsole that minimizes the likelihood of fixation injuries. The outsole includes a flexible sole extending the length of the wearer's foot with cleats on the sole over about the forward one-third of the sole and transverse ribs on the sole over about the rear two-thirds thereof so that the forward one-third provides the wearer with omnidirectional traction and the rear two-thirds provides the wearer with only longitudinal traction. Preferably the cleats and ribs are integral with the outsole. Preferably the ribs have a longitudinal profile as a saw-tooth, with the leading edges being substantially perpendicular to the plane of the sole and the trailing edges at an angle of about 45°. More preferably, the leading edges of adjacent ribs are about three-eighths of an inch apart.

Alternatively, the ribs may have leading edges which are arcuate.

The sole may have an upward extension at the rear of the foot and ribs continuing along the upward extension. In one embodiment, seven cleats are provided on the forward third of the shoe arranged in a two-three-two pattern. Typically, each of the cleats has the shape of a truncated cone.

BRIEF DESCRIPTION OF THE DRAWINGS

The invention will be better understood from a reading of the detailed description hereinafter and from a study of the drawings in which:

FIG. 1 is an elevational view of an athletic shoe including one embodiment of the invention;

FIG. 2 is a plan view of the outsole of the embodiment of FIG. 1;

FIG. 3 is a side view of an athletic shoe outsole according to a second embodiment of the invention;

FIG. 4 is a side view of the embodiment of FIG. 3 showing the outsole in a flexed condition; and FIG. 5 is a plan view of the outsole of a third embodiment.

DETAILED DESCRIPTION OF THE PREFERRED EMBODIMENTS

As seen in FIG. 1, an athletic shoe 10 includes an upper 12 and an outsole 14. The upper 12 may be of any desired configuration and of any suitable material. The outsole 14 is preferably unitary, formed of a flexible material such as hard rubber or suitable plastic.

As seen in FIG. 1, the outsole 14 has tread features including cleats 16 and ribs 18 formed integrally with the remainder of the outsole 14. The cleats are arranged spaced apart in an area forward of the point 20, and the ribs are arranged transversely of the shoe rearwardly of the point 20. Point 20 is located about one-third of the way rearward from the front of the shoe. As shown in FIG. 2, cleats 16 are arranged in a two-three-two pattern. By the term "two-three-two pattern" is meant an arrangement of seven cleats in three transverse rows, two in the front row, three in the middle row, and two in a rear row, substantially as shown in FIG. 2.

Rearward of the point 20, and continuing over about the rear two-thirds of the shoe are ribs 18. Ribs 18 extend transversely of the longitudinal axis of the shoe. They may curve rearwardly along the side edges of the shoe, as shown at 22 in FIG. 2. In the embodiment of FIGS. 1 and 2, the ribs are slanted forward, with arcuate leading edges 24 and arcuate trailing edges 26.

As will be apparent a wearer of the shoe will be able to maintain traction on a surface as he or she runs, including traction during turns and stops. The traction will arise from the cleats 16 and the ribs 18 digging into the ground. However, if the wearer's foot is planted in the ground and the lower part of the leg is displaced to one side or the other by a collision with another player, the ribs 18 will allow a sideways motion of the rear two-thirds of the shoe. The shoe pivots around its forward one-third having the cleats 16 with the rear two-thirds rotating. Thus the force of the collision will be absorbed by movement of the shoe and foot and not by injury to the wearer.

In the embodiments of FIGS. 3 to 5, the upper has been eliminated, but of course in a practical shoe the outsole 114 will be provided with an upper. In this embodiment the ribs 118 have a straight leading edge 124 substantially perpendicular to the plane of the outsole 114 and a straight trailing edge 126 at an angle of about 45° to the plane of the outsole 114. However, as shown in FIG. 4 the forwardmost rib 144 has a leading edge which is not perpendicular, but rather oblique to the outsole 114.

At its rear the outsole 114 has an upward extension 140 with ribs 142 extending transversely along it as well. Upward extension 140 aids in extremes of play for quick stops from forward motion. As in the first embodiment, the ribs 118 extend rearward of the point 120 which is about one-third of the length of the outsole from the front of the shoe. Forward of point 120 are integrally formed cleats 116 similar to the cleats of the first embodiment. In the embodiment of FIGS. 3 and 4, the 2-3-2 pattern of the cleats is repeated. However, in the embodiment of FIG. 5 nine cleats 150 are provided in an asymmetrical pattern. Other cleat patterns may be used.

As shown in FIG. 4, the outsole may flex at the point 120 to encourage the athlete to run on his or her toes, i.e. on the cleats 116, rather than running flat-footed. However, when the foot is placed flat on the ground, traction is provided over the entire length of the sole by cleats 116 and ribs 118. As with the first embodiment traction is omnidirectional with respect to cleats 116 and 156, but is only longitudinal with respect to ribs 118.

Preferably, cleats 116 take the form of a truncated cone having a base 146 with a diameter of $\frac{5}{8}$ of an inch, a height of $\frac{1}{4}$ of an inch, and a distal plane 148 with a diameter of $\frac{1}{2}$ inch. Preferably the distance between adjacent ribs 118 is $\frac{3}{8}$ inch.

Accordingly, an athletic shoe may be constructed using a tread design as disclosed herein with cleats on the sole over about the forward one-third thereof and transverse ribs on the sole over about the rear two-thirds thereof. The cleats on the forward one-third of the outsole provide the wearer with omnidirectional traction and the ribs on the rear two-thirds provide the wearer with longitudinal traction. These both help the athlete achieve sound footing during forward motion. However, when the foot is planted in the ground, a sideways force as from a colliding body will not cause the wearer injury because the shoe will pivot about the forward one-third and absorb the force by that motion, rather than by injury to the wearer.

I claim:

1. An athletic shoe outsole for minimizing the likelihood of injury to a wearer's foot from injuries attending fixation comprising:

a flexible sole extending the length of a wearer's foot with cleats on said sole over about the forward one-third thereof and a plurality of transverse ribs on said sole over about the rear two-thirds thereof, said ribs and said cleats being formed integrally with said sole, said ribs having a longitudinal profile as a sawtooth, said ribs having leading edges which are substantially perpendicular to said sole and trailing edges at an angle to said sole of about 45 degrees, said trailing edges extending in a direction toward the forward one-third of said outsole, said leading edges of adjacent ribs being about $\frac{3}{8}$ inch apart, whereby said forward one-third provides the wearer with omnidirectional traction and said rear two-thirds provide the wearer with only longitudinal traction.

2. An outsole as claimed in claim 1 wherein said cleats are formed in a 2-3-2 pattern along the longitudinal axis of said outsole.

3. An athletic shoe comprising an upper and a flexible outsole as defined in claim 1 extending the length of a wearer's foot and secured to said upper.

4. A shoe as claimed in claim 3 wherein said cleats are formed in a 2-3-2 pattern along the longitudinal axis of said outsole.

5. A shoe as claimed in claim 4 wherein each of said cleats has the shape of a truncated cone.

6. An athletic shoe outsole for minimizing the likelihood of injury to a wearer's foot from injuries attending fixation comprising:

a flexible sole extending the length of a wearer's foot with cleats on said sole over about the forward one-third thereof and a plurality of transverse ribs on said sole over about the rear two-thirds thereof, said ribs and said cleats being formed integrally with said sole, said ribs having a longitudinal profile as a sawtooth, said ribs having leading edges and trailing edges which are arcuate and depend from said outsole in a direction toward the forward one-third of said outsole, said leading edges of adjacent ribs being about $\frac{3}{8}$ inch apart, whereby said forward one-third provides the wearer with omnidirectional traction and said rear two-thirds provide the wearer with only longitudinal traction.

7. An athletic shoe comprising an upper and a flexible outsole as defined in claim 6 extending the length of a wearer's foot and secured to said upper.

* * * * *